US006830303B2

(12) United States Patent
Tamura

(10) Patent No.: US 6,830,303 B2
(45) Date of Patent: Dec. 14, 2004

(54) HEAD DRIVING APPARATUS OF LIQUID JET DEVICE

(75) Inventor: Noboru Tamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/407,908

(22) Filed: Apr. 7, 2003

(65) Prior Publication Data

US 2003/0227497 A1 Dec. 11, 2003

(30) Foreign Application Priority Data

Apr. 5, 2002 (JP) ..... P2002-104490

(51) Int. Cl.[7] ..... B41J 29/38
(52) U.S. Cl. ..... 347/9; 347/12
(58) Field of Search ..... 347/9, 12, 14, 347/19

(56) References Cited

U.S. PATENT DOCUMENTS 5,265,315 A * 11/1993 Hoisington et al. ..... 29/25.35
5,992,962 A * 11/1999 Yen et al. ..... 347/9
6,481,817 B1 * 11/2002 Torgerson et al. ..... 347/12

FOREIGN PATENT DOCUMENTS

JP 1-178455 7/1989
JP 6-115116 4/1994

* cited by examiner

*Primary Examiner*—Stephen D. Meier
*Assistant Examiner*—Alfred Dudding
(74) *Attorney, Agent, or Firm*—Sughrue Mion, PLLC

(57) ABSTRACT

A head driving apparatus including a plurality of piezoelectric elements, a switch circuit, a head driving circuit, a controller, and a determination unit. The controller supplies a control signal to the switch circuit so as to ON-OFF control the switch units every jet timing based upon jetting data. The determination unit calculates a total number of the switch units to be turned ON simultaneously in accordance with the control signal, and supplies a restriction signal to the switch circuit when the total number exceeds a predetermined number. A part of the switch units are turned OFF in spite of the control signal supplied from the controller when the switch circuit receives the restriction signal from the determination unit.

26 Claims, 10 Drawing Sheets

HEAD DRIVING APPARATUS OF LIQUID JET DEVICE

BACKGROUND OF THE INVENTION

The present invention is related to a head driving technique of a liquid jet device, which suppresses drive currents of piezoelectric elements provided in correspondence with nozzles used to jet liquid droplets in a jetting head of a liquid jet device, such as an ink-jet type printer.

Currently, while ink-jet type color printers In which several colors of ink droplets are jetted from recording heads have been popularized as output apparatus of computers, these ink-jet type color printers have been widely employed In order to print images processed by computers and the like in multicolor and multi-gradation modes.

For instance, in an ink-jet type printer using piezoelectric elements as driving elements for jetting ink, since a plurality of piezoelectric elements which are provided in correspondence with a plurality of nozzles of a print head are selectively driven, ink droplets are jetted from the nozzles based upon dynamic pressure of the respective piezoelectric elements, and the ink droplets are attached to print paper, so that dots are formed on this print paper so as to perform a printing operation.

In this case, the respective piezoelectric elements are provided in correspondence with nozzles used to jet the ink droplets therefrom, and are driven by drive signals which are supplied from a driver IC (head driving circuit) mounted within the print head so as to jet the ink droplets.

Such a head driving apparatus is arranged as shown in, for example, FIG. 10. In FIG. 10, a head driving apparatus 10 includes piezoelectric elements 11, a head driving circuit 12, a current amplifying circuit 13, and a nozzle selecting switch circuit 14. The piezoelectric elements 11 are provided in correspondence with a plurality of nozzles of an ink-jet printer. The head driving circuit 12 is employed so as to supply a drive signal with respect to one electrode 11*a* of each of these piezoelectric elements 11. The current amplifying circuit 13 and the nozzle selecting switch circuit 14 are provided between the head driving circuit 12 and each of the piezoelectric elements 11.

Each of the piezoelectric element 11 is constructed in such a manner that this piezoelectric element 11 is displaced in response to a voltage applied between both the electrodes 11*a* and 11*b*. The head driving circuit 12 is employed In order to generate a drive signal "COM" for driving the print head of the ink-jet printer, and is arranged, for example, within a main body of the ink-jet printer.

The current amplifying circuit 13 is constructed of two transistors 13*a* and 13*b*. Within these transistors 13*a* and 13*b*, a collector of the first transistor 13*a* is connected to a constant voltage source, a base thereof is connected to one output of the head driving circuit 12, and an emitter thereof is connected to an input side of the nozzle selecting switch circuit 14. As a result, this first transistor 13*a* becomes conductive in response to a signal supplied from the head driving circuit 12, and thus, supplies a drive waveform having a trapezoidal shape via the nozzle selecting switch circuit 14 to the piezoelectric elements 11.

Also, an emitter of the second transistor 13*b* is connected to an input side of the nozzle selecting switch circuit 14, a base thereof is connected to a second output of the head driving circuit 12, and a collector thereof is connected to the ground. As a result, the second transistor 13*b* becomes conductive in response to a signal supplied from the head driving circuit 12, and thus, discharges the piezoelectric elements 11 via the nozzle selecting switch circuit 14.

The nozzle selecting switch circuit 14 is turned ON at drive timing of the corresponding piezoelectric element 11 by inputting thereinto a control signal, and then, outputs the drive signal COM to the piezoelectric element 11. In an actual case, this nozzle selecting switch circuit 14 is arranged as a so-called "transmission gate (TG)" in order to turn ON/OFF the respective piezoelectric elements 11. In this case, in the head driving apparatus 10 having such an arrangement, the current amplifying circuit 13 may drive all of the piezoelectric elements 11 connected by one set of these transistors 13*a* and 13*b*.

As a consequence, since a transistor having such a maximum current capable of supplying a current required when all of the piezoelectric elements 11 are driven at the same time is needed as these transistors 13*a* and 13*b*, the transistors used in the current amplifying circuit 13 are relatively high cost, so that the cost of the resulting head driving apparatus 10, and thus, the cost of an ink-jet type printer using this head driving apparatus 10 are increased. Also, when the large currents flow through the transistors, waveforms thereof are easily distorted.

Furthermore, in some cases, for instance, plural stages of transistors such as Darlington-connected transistors must be employed so as to supply a large current, so that the cost thereof would be increased and the characteristic thereof would be deteriorated.

On the other hand, in the head driving apparatus 10, there is a rare case that all of the piezoelectric elements 11 are simultaneously driven during the normal printing operation. In general, a half, or a smaller number of the entire piezoelectric elements 11 are driven at the same time. More specifically, this trend may become conspicuous in such a case that multiple color ink is used in a color printer. For example, in the case of a six-colored ink printer, ⅓, or smaller number of piezoelectric elements are driven at the same time in an average condition. If more than ⅓ of piezoelectric elements are driven at the same time, print paper is excessively wet, so that better printing operation cannot be carried out. To the contrary, there is a very small possibility that all of ink nozzles are locally jetted. In other words, if all of ink nozzles are jetted and thereafter a time period is provided during which all of ink nozzles are not jetted, then all of ink nozzles may be locally jetted in, for example, a six-color ink printer, even when the entire nozzle number is averaged to become approximately ⅓ of the total ink nozzle number.

As a consequence, such a head driving apparatus has been proposed in, for example JP-A-6-115116 and JP-A-1-178456. In this head driving apparatus, when print data is entered by which a predetermined number, or larger numbers of loads are simultaneously driven, since a total number of such loads which are driven at the same time is limited, a transistor having a smaller maximum current is used.

In the head driving apparatus of JP-A-6-115116, the method for processing the print data by the MPU so as to limit the total ON-number of the nozzle selecting switch circuit has been proposed.

Also, in the head driving apparatus of JP-A-1-178455, such a method has been proposed. That is, while the output current of the current amplifying circuit is monitored, when this output current is increased higher than the predetermined value, the total ON-number of the nozzle selecting switch circuit is limited.

However, the above-described methods own the below-mentioned problems. That is, in the case of JP-A-6-115116, since the print data is sequentially processed by the MPU, the data processing speed is restricted, so that the printing speed would be suppressed. Otherwise, since the highspeed-operable MPU must be employed, the cost of the head driving apparatus is increased.

Also, in the case of JP-A-1-178455, when the output current supplied from the power supply actually becomes larger than, or equal to a predetermined current value, a total number of piezoelectric elements which are subsequently driven is restricted. This method has a major object capable of protecting the power supply. Even when a large current having a pulse shape instantaneously flows from the power supply, if the subsequently-driven load is light, then there is no problem as to this power supply. On the other hand, in such a case that this method has an object capable of protecting the transistor, an actual drive current never exceeds a prelimited current even in an instantaneous time instant. However, even when actually flowing currents are monitored, there is a certain possibility that an actual drive current may instantaneously exceed the normal value as to the maximum current of the transistor used in the current amplifying circuit. Under certain condition, the transistor is damaged, or is brought into a break down state.

SUMMARY OF THE INVENTION

It is therefore an object of the present invention to provide a head driving apparatus having a simple arrangement of a liquid jet device, capable of amplifying drive current signals, while an amplifying element having a relatively smaller maximum current is employed.

In order to achieve the above object, according to the present invention, to solve the above-described problem, in a head driving apparatus of the present invention, a total number of nozzles which should be simultaneously driven is calculated based upon a control signal supplied to a switch circuit, and when the calculated total nozzle number exceeds a preselected number, only a portion of entire piezoelectric elements corresponding to the nozzles is driven so as to perform a printing operation.

That is to say, a head driving apparatus comprising:

a plurality of nozzles;

a switch circuit, having a plurality of switch units corresponding to the nozzles, and selecting the nozzles from which a liquid droplet is jetted at predetermined jet timing;

a head driving circuit, supplying a drive signal to the switch circuit to jet the droplet from the nozzles;

a controller, supplying a control signal to the switch circuit so as to ON-OFF control the switch units every jet timing based upon jetting data; and a restriction signal generator, generating a restriction signal, wherein a part of the switch units are turned OFF in spite of the control signal supplied to the switch circuit when the switch circuit receives the restriction signal.

Preferably, the restriction signal generator calculates a total number of the switch units to be turn ON simultaneously in accordance with the control signal, and supplies a restriction signal to the switch circuit when the total number exceeds a predetermined number.

In the above configurations, the determination unit calculates a total number of the switch units which must be turned ON, namely, a total quantity of the piezoelectric elements to which the drive signals must be applied at the same time based upon the control signal every jet timing In such a case that this calculated quantity does not exceed a predetermined number, the determination unit does not output the restriction signal with respect to the switch circuit.

As a consequence, the switch circuit ON/OFF-controls the switch units corresponding to the respective piezoelectric elements based upon the control signal supplied from the printer main body, and thus, selectively applies the drive signals amplified by the current amplifying circuit to the respective piezoelectric elements, so that the printing operation may be carried out.

In this case, if the total number of the switch units to be simultaneously turned ON which has been calculated every jet timing exceeds the predetermined number, namely if the total quantity of the piezoelectic elements to which the drive signals must be simultaneously applied exceeds the predetermined number, then the determination unit outputs the restriction signal with respect to the switch circuit.

Then, the switch circuit turns OFF a part of the switch units irrespective of the control signal supplied from the printer main body, and also, ON/OFF-controls only other switch units corresponding to the respective piezoelectric elements based upon the control signal supplied from the printer main body, so that the switch circuit may selectively apply the drive signals amplified by the current amplifying circuit to the respective piezoelectric elements.

As a result, since the partial switch units are turned OFF, the piezoelectric elements corresponding to these partial switch units are not driven, so that the printing operation is not carried out. As a consequence, since the total number of piezoelectric elements which are turned ON at the same time is limited, the output current of the current amplifying circuit for amplifying the drive signal is limited lower than, or equal to a predetermined value. Accordingly, while the maximum current of the amplifying element employed In the current amplifying circuit may be selected to be the small maximum current, the cost thereof may be reduced, and also, such an arrangement of multiple stages is no longer required, and further, the characteristic thereof may be improved.

Also, after all of the data every jet timing have been finished to be transferred, the judging operation is carried out by the determination unit, so that the judging operation may be quickly carried out, the highspeed printing operation may be properly carried out, and also, the judging operation may be performed before the printing operation is actually carried out. As a result, there is no possibility that the current larger than, or equal to a predetermined current value may flow.

Preferably, the predetermined number is a half number of the entire switch units, and the switch circuit turns OFF a half number of the entire switch units when the switch circuit receives the restriction signal.

In the above configuration, upon receipt of the restriction signal from the determination unit, the nozzle selecting circuit turns OFF a half number of the entire switch units irrespective of the control signal derived from the main body of the liquid Jetting apparatus, and also, ON/OFF-controls only a remaining half number of the switch units corresponding to the respective piezoelectric elements based upon the control signal supplied from the main body of the liquid jetting apparatus, so that the drive signals amplified by the current amplifying circuit are selectively applied to the respective piezoelectric elements.

As a consequence, since the half number of the above-explained switch units are turned OFF, a total number of piezoelectric elements which are driven at the same time is limited to a half number of the entire piezoelectric elements, so that the output current of the current amplifying unit for amplifying the drive signals can be limited smaller than, or equal to a predetermined value. Accordingly, while the maximum current of the amplifying element of the current amplifying circuit may be made small, the cost thereof can be reduced, the arrangement having the multiple stage is no longer required, and thus, the characteristic thereof can be improved.

Preferably, a first jetting operation is performed while the switch circuit brings a part of the switch units into OFF state based upon the restriction signal, and a second jetting operation is performed on the same path while the switch circuit brings the part of the switch units into ON state and another part of the switch units into OFF state after the first jetting operation is performed.

In the above configuration, when the total number of the switch units to be simultaneously turned ON, which has been calculated every jet timing, namely, the number of the piezoelectric elements to which the drive signals should be applied, exceeds a predetermined number, and then, the determination unit outputs the restriction signal with respect to the switch circuit, the switch circuit sequentially uses all of the switch units every plural sets of these switch units to perform the printing operations respectively. As a result, while a total number of the piezoelectric elements which are simultaneously driven is limited, the entire printing operation can be firmly carried out.

Here, it is preferable that, a first jetting operation is performed while the switch circuit brings a half number of the entire switch units into OFF state based upon the restriction signal, and a second jetting operation is performed on the same path while the switch circuit brings the half of the switch units into ON state and a remained part of the switch units into OFF state after the first jetting operation is performed.

In the above configuration, when the total number of the switch units to be simultaneously turned ON, which has been calculated every Jet timing, namely, the number of the piezoelectric elements to which the drive signals should be applied, exceeds a predetermined number, and then, the determination unit outputs the restriction signal with respect to the switch circuit, the switch circuit sequentially uses all of the switch units every a half set of the entire switch units to perform the printing operations respectively. As a result, while a total number of the piezoelectric elements which are simultaneously driven is limited, the entire printing operation can be firmly carried out.

Furthermore, in this case, the output current of the current amplifying circuit may be reduced to a half value thereof, and the entire printing operation may be completely carried out by executing the printing operation two times.

Preferably, the restriction signal generator calculates a simultaneous drivable number of piezoelectric elements applying pressure to liquid so as to jet a liquid droplet from the nozzles, based upon a maximum inclination of a waveform of the drive signal, a capacitance of the piezoelectric element per a single nozzle, and an allowable current of an amplifier circuit which amplifies the drive signal, and stores the calculated result as the predetermined number.

In the above configuration, for instance, even when the jetting mode is switched, or the capacitances of the piezoelectric elements are changed due to temperature changes, since the simultaneous drivable number of the optimum piezoelectric elements is stored as the predetermined number, the output current of the current amplifying circuit during the printing operation can be firmly restricted to become smaller than, or equal to the maximum current of the amplifying element which constitutes the current amplifying circuit.

According to the present invention, there is also provided a nozzle selecting IC, comprising;

a selector, selecting a jetting nozzle from a plurality of nozzles based upon jetting data; and a restrictor, restricting a specific nozzle of the nozzles to a non-jetting state in response to a restriction signal supplied from an external in spite of the jetting data.

In the above configuration, since the specific nozzle can be set to the non-jetting nozzle by receiving the restriction signal irrespective of the print data, a total quantity of such piezoelectric elements which are simultaneously driven can be limited, so that the output current of the current amplifying circuit for amplifying the drive signal may be limited to become smaller than, or equal to the predetermined value. As a consequence, while the maximum current of the amplifying element of the current amplifying circuit may be selected to be a small maximum current, the cost thereof may be reduced, and such an arrangement of multiple stages is no longer required, and further, the characteristic thereof may be improved.

According to the present invention, there is also provided a method for driving a head driving apparatus, comprising the steps of:

providing a plurality of nozzles;

supplying a drive signal for jetting the liquid droplet from the nozzles;

supplying a control for controlling a jet of the liquid droplet based upon jetting data every jet timing;

selecting the nozzles from which the liquid droplet is jetted in accordance with the control signal at predetermined jet timing; and restricting a part of the nozzle into a non jetting state in spite of the control signal.

Preferably, the method further comprises a step of calculating a total number of the nozzles from which the liquid droplet is jetted simultaneously in accordance with the control signal, and the part of the nozzle is restricted into a non jetting state in spite of the control signal when the total number exceeds a predetermined number.

Preferably, a half number of the entire nozzles are restricted into the non jetting state when the total number exceeds a predetermined number.

Preferably, the method further comprising:

performing a first jetting operation while a part of the nozzles are restricted into non jetting state; and performing a second jetting operation on the same path while the part of the nozzles are jetting state and another part of the nozzles are non jetting state.

Here, it is preferable that, the method further comprising:

performing a first jetting operation while the half number of the entire nozzles are restricted into non jetting state; and performing a second jetting operation on the same path while the half of the entire nozzles are jetting state and the remained part of the nozzles are non jetting state.

According to the present invention, there is also provided a head driving apparatus, comprising:

a plurality of nozzles from which a liquid droplet is jetted;

a data storing unit storing jetting data for jetting the liquid droplet on a one path in a movement of a jetting head having the nozzles, the jetting data having a first part and a second part; and a divider, dividing the jetting data, wherein the liquid droplet is jetted in accordance with a first part of the jetting data in a jetting operation of the one path;

wherein the divider divides the second part of the jetting data Into a plurality of divided data; and wherein the liquid droplet is jetted in a plurality of jetting operations in accordance with the plurality of divided data respectively after the jetting operation is finished.

Preferably, the head driving apparatus further comprises an identifier which adds identification information to the second part of the jetting data.

Preferably, the liquid droplet is jetted in accordance with the jetting data added with the identification information.

Preferably, the first part and the second part of the jetting data are defined during the liquid droplet is jetted in accordance with the jetting data.

According to the present invention, there is also provided a method for driving a head driving apparatus, comprising the steps of:

providing a plurality of nozzles from which a liquid droplet is jetted;

providing a data storing unit;

providing a divider;

storing a jetting data in the data storing unit, the data having a first part and a second part;

jetting the liquid droplet in accordance with a first part of the jetting data in a jetting operation of a one path;

dividing the second part of the jetting data into a plurality of divided data;

jetting the liquid droplet in accordance with the divided data after the jetting operation is finished; and repeating the jetting step of the divided data until the liquid droplet is jetted in accordance with all divided data.

Preferably, the method further comprises the step of adding identification information to the second part of the jetting data Preferably, the liquid droplet is jetted In accordance with the jetting data added with the identification information.

Preferably, the first part and the second part of the jetting data are defined during the liquid droplet is jetted in accordance with the jetting data.

BRIEF DESCRIPTION OF THE DRAWINGS

The above objects and advantages of the present invention will become more apparent by describing in detail preferred exemplary embodiments thereof with reference to the accompanying drawings, wherein:

FIG. 9B shows a printing result of this modification.

DETAILED DESCRIPTION OF THE PREFERRED EMBODIMENTS

Referring now to drawings, a description will be made of a head driving apparatus of a liquid jetting apparatus according to an embodiment of the present invention. It should be understood that since the below-mentioned embodiments are preferable concrete examples of the present invention, various sorts of technically preferable restrictions have been made thereto. However, a technical scope of the present invention is not limited only to these preferred embodiments unless such a description for restricting the present invention is made in the below-mentioned explanations.

Figure 1:
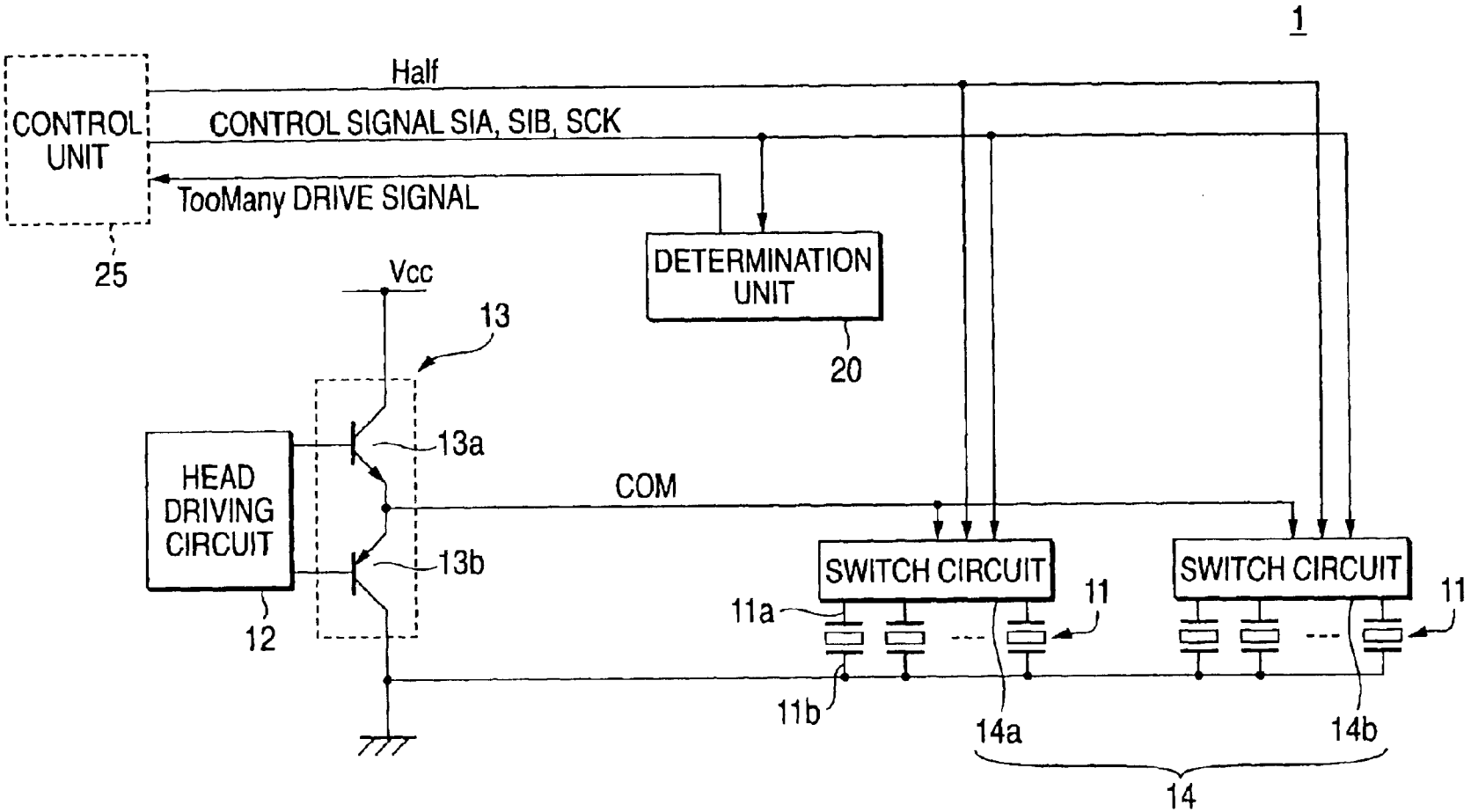
FIG. 1 is a block diagram which shows an arrangement of a head driving apparatus of an liquid jetting apparatus according to an embodiment of the present invention.

FIG. 1 shows an arrangement of a head driving apparatus 1 of an ink-jet type printer according to an embodiment of the present invention. In FIG. 1, this head driving apparatus 1 Includes piezoelectric elements 11, a head driving circuit 12, a current amplifying circuit 13, a nozzle selecting switch circuit 14, and a determination unit 20. The piezoelectric elements 11 are provided in correspondence with a plurality of nozzles of a printer head. The head driving circuit 12 is employed so as to supply a drive signal with respect to one electrode 11*a* of each of these piezoelectric elements 11. The current amplifying circuit 13 and the nozzle selecting circuit 14 are provided between the head driving circuit 12 and each of the piezoelectric elements 11. The determination unit 20 is employed to control the nozzle selecting switch circuit 14.

In this case, in FIG. 1, the piezoelectric elements 11 are actually arranged in such a manner that a single nozzle row is provided as to each of the respective colors in a printer head of an ink-jet type printer 10, and the respective piezoelectric elements are provided with respect to the respective nozzle row.

Figure 2:
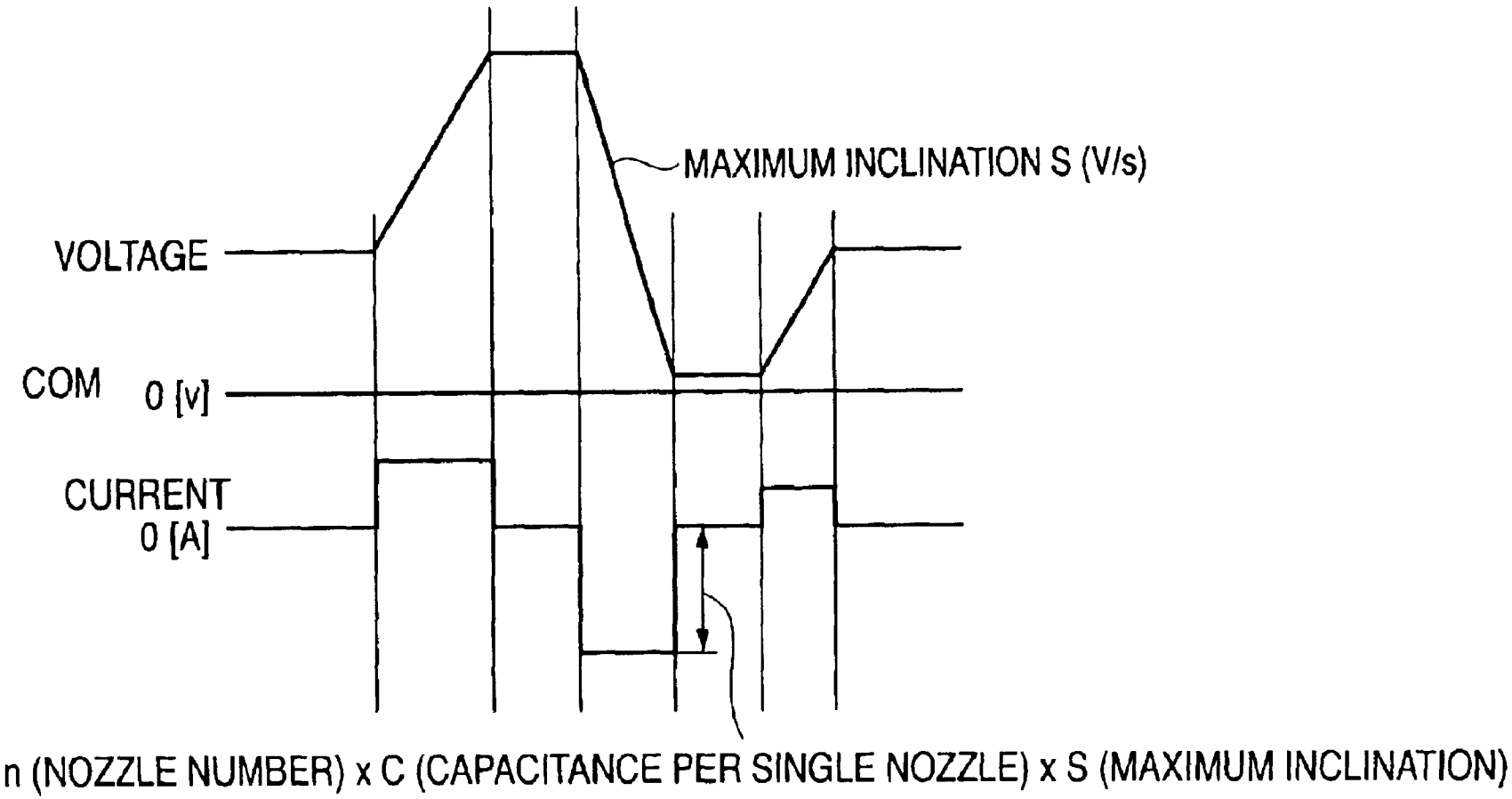
FIG. 2 is a diagram which shows respective waveforms of a voltage and a current of a drive signal "COM" used in the head driving apparatus of FIG. 1.

Then, a drive signal "COM" having such a waveform shown in FIG. 2 derived from the head driving circuit 12 is outputted via the nozzle selecting switch circuit 14 with respect to piezoelectric elements for performing ink jetting operation of each of the nozzle row.

Each of the piezoelectric elements 11 is constructed in such a manner that this piezoelectric element 11 is displaced in response to a voltage applied between both electrodes thereof 11*a* and 11*b*. Then, the piezoelectric elements 11 are constituted in such a manner that since pressure is applied to ink contained in nozzles corresponding to the piezoelectric elements 11 when being discharged based upon the drive signal "COM", ink droplets are jetted from these nozzles.

The head driving circuit 12 generates the drive signal "COM" used for the printer head of the ink-jet type printer 10. The current amplifying circuit 13 includes two transistors 13*a* and 13*b*.

Within these two transistors 13*a* and 13*b*, a collector of the first transistor 13*a* is connected to a constant voltage power (for instance, DC power supply of +42V), a base thereof is connected to one output of the head driving circuit 12, and also an emitter thereof is connected to an input side of the switch circuit 14. As a result, this first transistor 13*a* becomes conductive in response to a drive signal waveform supplied from the head driving circuit 12, and thus, supplies a drive voltage waveform via the nozzle selecting switch circuit 14 to the piezoelectric elements 11.

Also, an emitter of the second transistor 13*b* is connected to an input side of the nozzle selecting switch circuit 14, a base thereof is connected to a second output of the head driving circuit 12, and also a collector thereof is connected to the ground. As a result, the second transistor 13*b* becomes conductive in response to a drive signal waveform supplied from the head driving circuit 12, and thus, discharges the piezoelectric elements 11 via the nozzle selecting switch circuit 14. In this case, as will be explained later, as to these two transistors 13*a* and 13*b*, such transistors whose maximum current values are relatively small are used.

The nozzle selecting switch circuit 14 is actually constructed as a so-called "transmission gate" which may turn ON/OFF each of the piezoelectric elements 11. It should also be noted in the case shown in this drawing, this nozzle selecting switch circuit 14 includes two transmission gates 14*a* and 14*b*.

Then, each of the transmission gates 14*a* and 14*b* is provided with switch units (not shown) corresponding to the respective piezoelectric elements 11. These switch units are arranged in such a way that the drive signal COM is applied thereto at timing when a selected piezoelectric element 11 is driven based upon a control signal supplied from a main body of the ink-jet type printer 10. In the case shown in this drawing, the aligned piezoelectric elements 11 are subdivided into two element groups from a center thereof, and then, these element groups are allocated to the respective transmission gates 14*a* and 14*b*.

Figure 3:
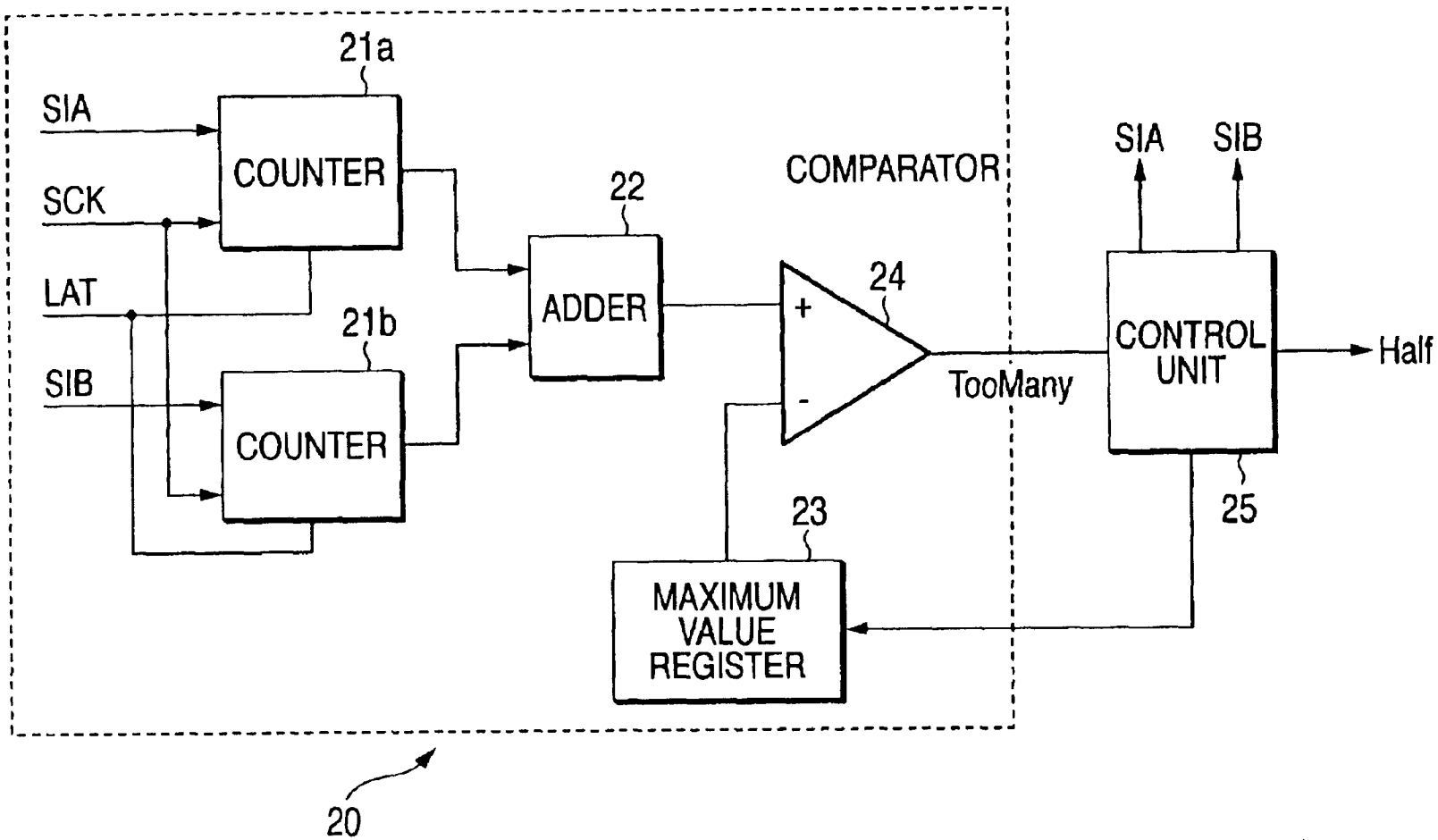
FIG. 3 is a block diagram which shows an arrangement of a determination unit employed in the head driving apparatus of FIG. 1.
Figure 4:
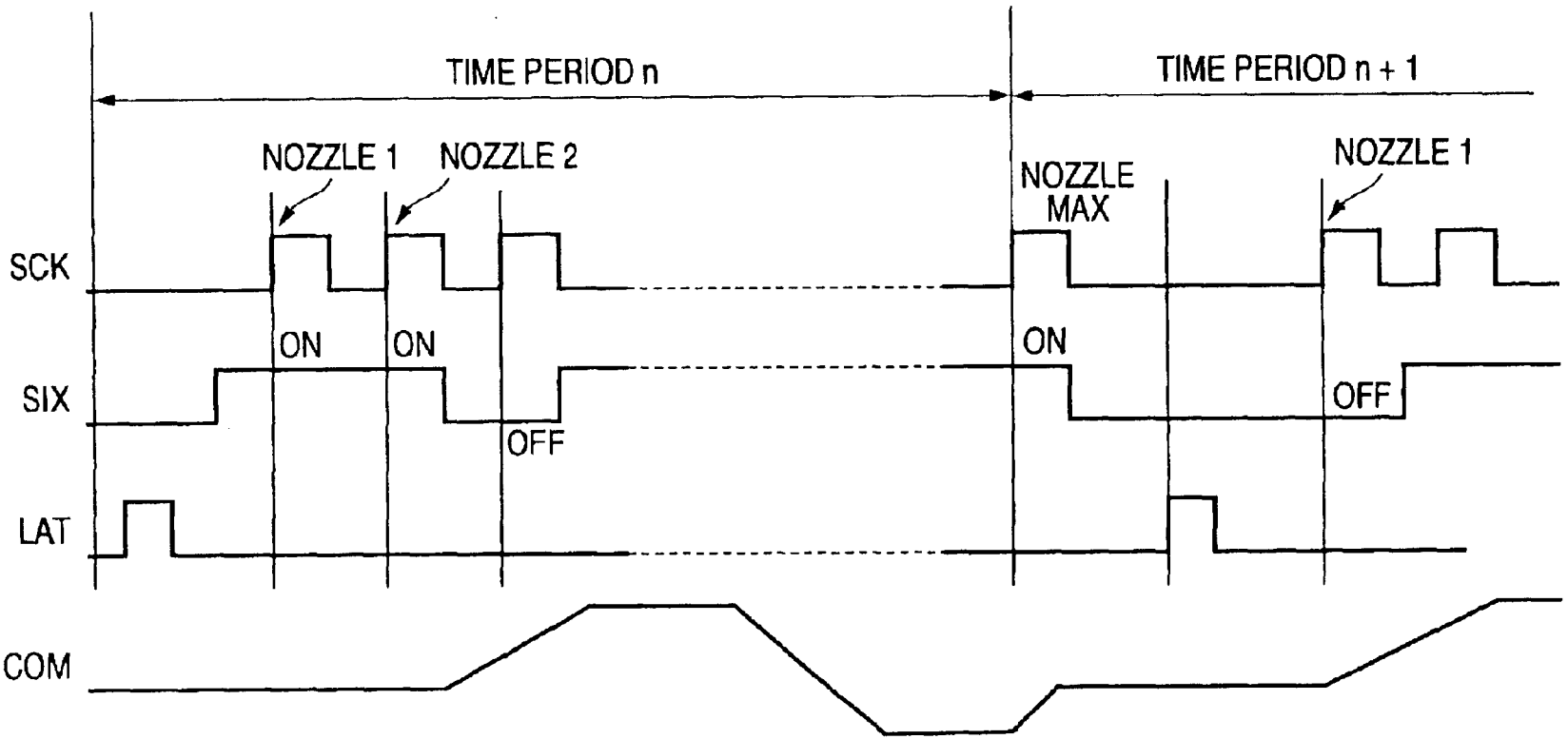
FIG. 4 is a timing chart which shows respective signals SI (A, B), SCK, and LAT, which are inputted to the determination unit of FIG. 3.

As shown in FIG. 3, the determination unit 20 includes two counters 21*a* and 21*b*, an adder 22, a maximum value register 23, and a comparator 24. Into the counters 21*a* and 21*b*, a control signal "SI" derived from the control unit 25 of the printer main body, namely, control signals SIA, SIB, and SCK corresponding to the respective transmission gates 14*a* and 14*b* are entered respectively. Into the adder 22, count values of these counters 21*a* and 21*b* are entered. The maximum value register 23 stores thereinto a maximum value of simultaneous drivable numbers of the piezoelectric elements 11. The comparator 24 compares an added value of the adder 22 with the maximum value of the maximum value register 23. The control signals SI and SCK correspond to such signals for determining ON/OFF operations of the respective switches of the switch circuit 14, and as shown in FIG. 4, correspond to serial transfer data. The ON/OFF states of the respective nozzles are determined based upon levels of the control signals SIX at rising edges of the control signal SCK. In response to a pulse of a signal "LAT", data which have been so far transferred are reflected to switches. In other words, in FIG. 4, the data which have been transferred in a time period "n" are reflected to jetting operations of another time period "n+1".

The two counters 21*a* and 21*b* count a total number of the piezoelectric elements 11 driven by each of the transmission gates 14*a* and 14*b* from the respective control signals SIA and SIB every jet timing. In other words, when a level of the signal LAT becomes a "High level", the counters 21*a* and 21*b* are cleared while the control signal SI is inputted to so-called "count enable" terminals of the counters 21*a* and 21*b*, if a level of the control signal SI is a "High level" at a rising pulse of the control signal SCK, then the counters 21*a* and 21*b* are incremented by "1".

The adder 22 adds the count values entered from the two counters 21*a* and 21*b* to each other so as to calculate a total number of the piezoelectric elements 11 which are driven by the nozzle selecting switch circuit 14.

The maximum value register 23 is designed in such a manner that the simultaneous drivable number of the piezoelectric elements 11 is entered as the maximum value from the control unit 25 of the printer main body, and is stored thereinto. The maximum value register 23 outputs this maximum value to the comparator 24.

The comparator 24 compares the added value derived from the adder 22 with the maximum value outputted from the maximum value register to output an output signal "Too Many". In this case, the comparator 24 outputs such an output signal "Too Many" having an L-level when the added value is smaller than the maximum value, and furthermore, outputs such an output signal "Too Many" having an H-level when the added value is larger than the maximum value.

The control unit 25 calculates a simultaneous drivable number "N" of the nozzles, namely of the piezoelectric elements 11 by employing a formula $N=I/(C\times S)$ based upon a maximum inclination "S(V/s)" of a drive waveform of the drive signal "COM" derived from the head driving circuit 12, a capacitance "C(F)" per a single nozzle, and an allowable current "I(A)" of the circuit. Then, the control unit 25 outputs this calculated simultaneous drivable number "N" as the maximum value to the maximum value register 23 so as to store this maximum value into the maximum value register 23.

In this case, in response to the output signal "Too Many" derived from the comparator 24, when a level of this output signal is an "H"-level, the control unit 25 outputs a restriction signal "Half" having an "H"-level to the respective transmission gates 14*a* and 14*b* of the nozzle selecting switch circuit 14 after the next LAT pulse until printing operation of this path is ended.

Furthermore, based upon the output signal "Too Many" derived from the comparator 24, the control unit 25 stores a time period (column) during which the level of this output signal becomes an "H"-level at the first. As a consequence, since the control unit 25 outputs the restriction signal "Half" having the "H"-level to the respective transmission gates 14*a* and 14*b*, the control unit 26 thereafter turns OFF the respective switch units of one transmission gate, for example, 14*b*, and ON/OFF-controls the respective switch units as to only the other transmission gate 14*a* based upon the control signal SIA so as to execute the printing operation.

Thereafter, the control unit 25 turns OFF the respective switch units of the other transmission gate 14*a* from the time period when the level of the output signal becomes an "H"-level in the same path, and ON/OFF-controls the respective switch units as to only one transmission gate 14*b* based upon the control signal "SIB" so as to execute the printing operation.

The head driving apparatus 10 according to this embodiment of the present invention is arranged in the manner, and is operated as follows: First, in the ink-jet type printer 10, when the power supply is turned ON, or the printing operation is commenced, the control unit 25 acquires a maximum inclination "S" of a waveform of the drive signal "COM" based upon a temperature and a printing mode at this time, and calculates a simultaneous drivable number "N" in accordance with the formula 1 based upon a maximum allowable current "I" ("I" is obtained by subtracting margin from rated current) of each of the transistors 13*a* and 13*b* of the current amplifying unit 13, and a capacitance per a single nozzle. Then the control unit 25 outputs this simultaneous drivable number "N" as the maximum value to the maximum value register 23 so as to store thereinto this maximum value.

Figure 5:
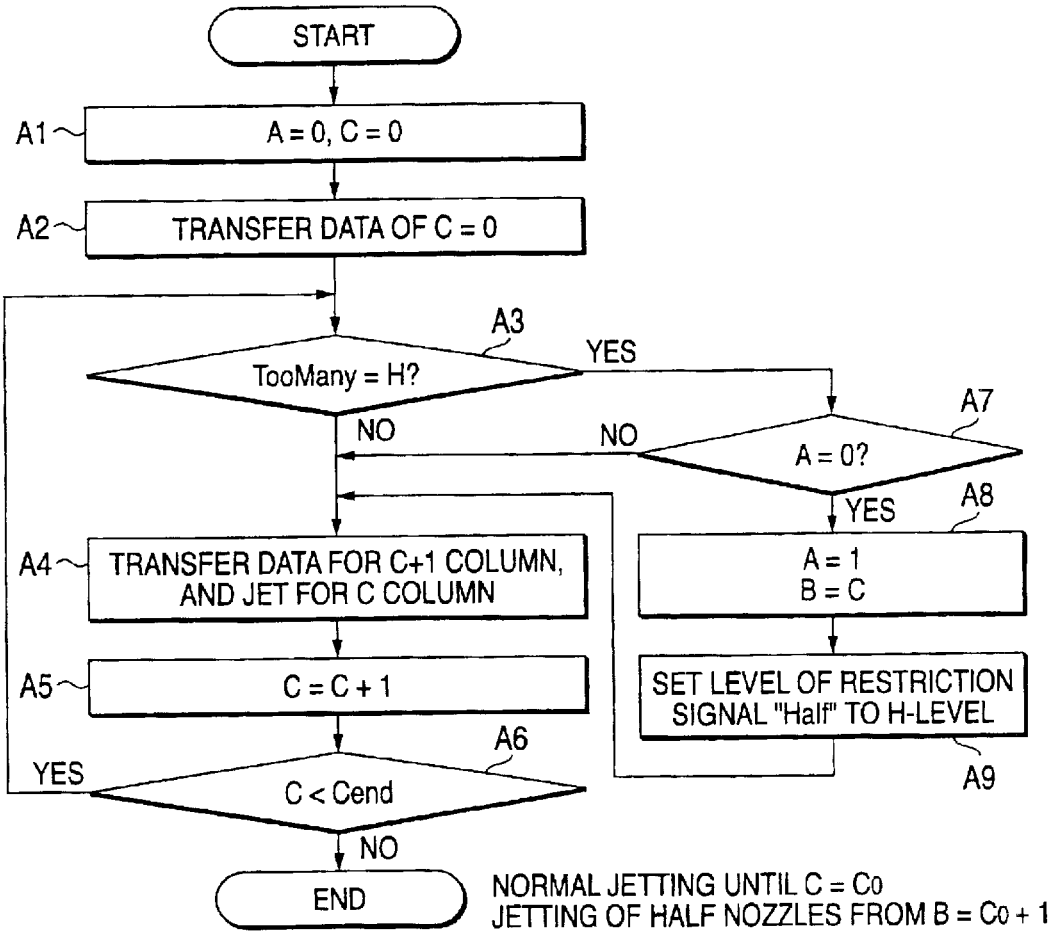
FIG. 5 is a flow chart which shows printing operation executed every column in the head driving apparatus of FIG. 1.

Then, a printing operation is performed. First, a printing operation every column will be firstly explained. While the printing operation every column is carried out, process operation shown in a flow chart of FIG. 5 is carried out every jet timing. In this case, a column corresponds to 1 time period of FIG. 4.

That is, in the flow chart of FIG. 5, "START" corresponds to timing when 1 path is started. In a step A1, the control unit 25 sets a flag A=0, and also sets a column number C=0. It should be understood that as to this flag "A", "0", indicates a printing operation executed by driving all of the piezoelectric elements 11, whereas "1" indicates another printing operation executed by driving a half of the entire piezoelectric elements 11.

Subsequently, in a step A2, print data is transferred. In a step A3, the control unit 25 judges as to whether or not a level of an output signal "Too Many" of the comparator 24 is an "H"-level.

Then, in the case that the level of the output signal "Too Many" is an "L"-level, the control unit 25 continues to perform the printing operation in a step A4. When the jetting operation for 1 time period (namely, 1 column) is accomplished, the control unit 25 sets C=C+1 in a step A5.

In this case, the control unit 25 judges as to whether or not "C" is smaller than "Cend" (Symbol "Cend" indicates column number for jetting operations) In a step A6. In the case of C<Cend, the printing operation is again returned to the previous step A3, and the control unit 25 judges as to whether or not a level of an output signal "Too Many" of the comparator 24 is an "H"-level., and the control unit 25 executes a jetting operation as to the next column. Also, in the case of C≧Cend in the step A5, the control unit 25 completes the printing process operation every column.

To the contrary, in such a case that the level of the output signal "Too Many" is the "H"-level in the step A3, the control unit 25 judges as to whether or not "A" is equal to "0" in a step A7. In the case of "A" is not equal to "0", the printing process operation is advanced to a step A4 in which the control unit 25 performs a jetting operation. In the case that "A" is equal to "0", the control unit 25 sets A=1 and C=B and thereafter executes a jetting operation in a step A8. Furthermore, in a step A9, the control unit 25 sets the level of the restriction signal "Half" to an "H"-level in order to prepare a printing operation of a next column (time period), and outputs this restriction signal "Half" having the "H"-level to the respective transmission gates 14*a* and 14*b* of the nozzle selecting switch circuit 14, and then, the printing process operation is returned to the previous step A4.

In this case, the respective switch units of one transmission gate 14*a* are turned OFF in response to the restriction signal "Half" having the "H"-level, whereas only the respective switch units of the other transmission gate 14*b* are ON/OFF-controlled based upon the control signal supplied from the control unit 25.

Figure 6A:
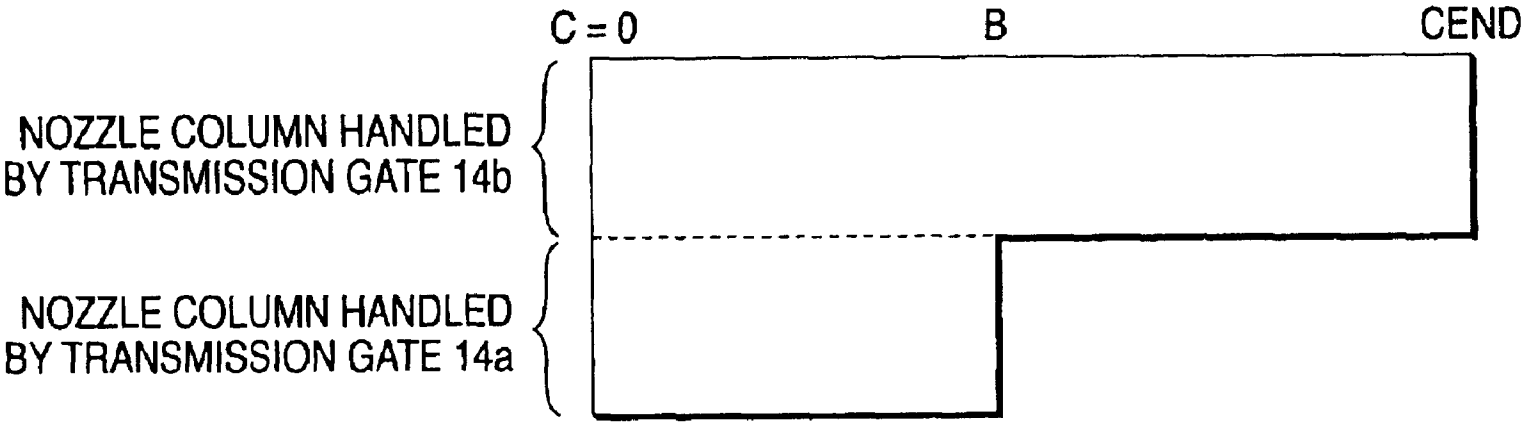
FIG. 6A shows a first printing condition.

As a result, as shown in FIG. 6A, after a certain column C=B, only the piezoelectric elements 11 corresponding to the other transmission gate 14*b*, and ink is jetted only from such nozzles corresponding to these driven piezoelectric elements 11, so that only a half area may be printed out.

Figure 7:
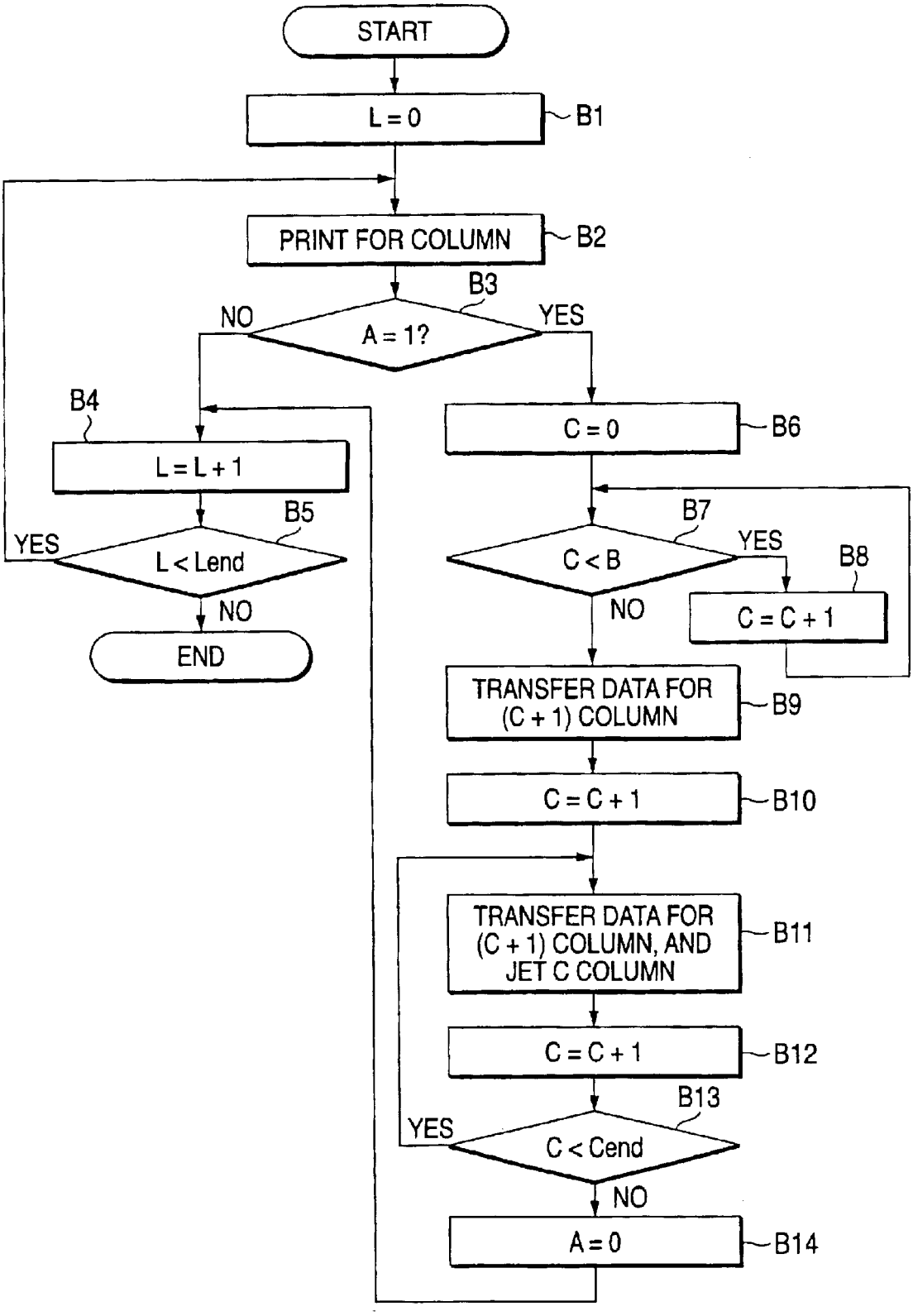
FIG. 7 is a flow chart which shows printing operation executed every row in the head driving apparatus of FIG. 1.
Figure 8:
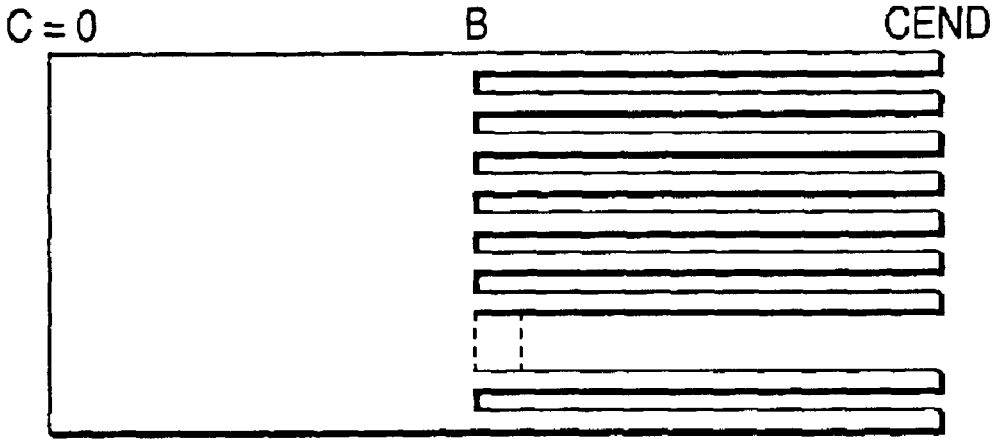
FIG. 8 is a schematic diagram which shows a modification of a first printing condition when a restriction signal is outputted by the head driving apparatus of FIG. 1.

Next, a description will now be made of a printing operation every row (namely, path) with reference to a flow chart shown in FIG. 7. In the flow chart of FIG. 7, when a printing operation is commenced, the control unit 25 sets a row number L=0 in a step B1, and then, executes the printing operation every column as shown in FIG. 5 in a step B2.

Thereafter, the control unit 25 judges as to whether or not "A" is equal to "1" in a step B3. In the case of "A" is not equal to "1" the control unit 25 sets L=L+1 in a step B4, and then, the printing process operation is advanced to a next path.

In this case, in a step B5, the control unit 25 judges as to whether or not "L" is smaller than "Lend" (Symbol "Lend" indicates jetting row number). In the case of L<Lend, after a paper feeding operation is carried out, the printing process operation is again returned to the previous step B2 in which the control unit 25 executes a printing operation for a next row. Also, in the case of L≧Lend in a step B5, the control unit 25 accomplishes the printing process operation every row.

In contrast to the case, In such a case that A=1 in the step B3, since the printing operation of FIG. 6A is being carried out, the control unit 25 is returned to the first column without paper feeding operation, and resets the present state to C=0 in a step B6. In a step B7, the control unit 25 judges as to whether or not "C" is smaller than "B".

In such a case of C<B, since this column is such a column which has already been printed out by using all of the piezoelectric elements 11, the control unit 25 increments only the column number without jetting operation in a step B8, and then, the printing process operation is again returned to the previous step B7.

Then, in the case of C≧B in the step B7, in a step B9, the control unit 25 sets all of the control signals SIB to "0" as to the other transmission gate 14*b* which has not yet been turned OFF by the restriction signal "Half", and also, the control unit 25 directly transfers the control signal "SIA" as to one transmission gate 14*a* which has been turned OFF by the restriction signal "Half". In a step B10, the control unit 25 sets the present state to C=C+1. In a step B11, the control unit 25 moves the printing operation by 1 column, and executes a jetting operation for a lower half remaining area for 1 column.

Thereafter, the control unit 25 sets the present state to C=C+1 in a step B12 after the printing operation has been ended in the step B11. In this case, the control unit 25 judges as to whether or not "C" is smaller than "Cend" (symbol "Cend" indicates column number for jetting operations) in a step B13. In the case of C<Cend, the printing operation is again returned to the previous step B11, and then, the control unit 25 executes a jetting operation as to the next column.

Figure 6B:
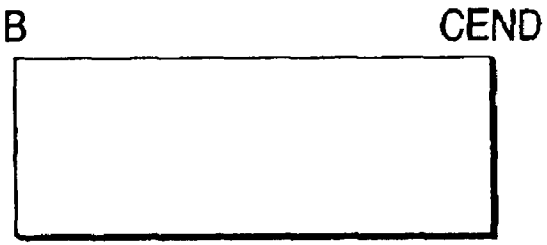
FIG. 6B shows a second printing condition when a restriction signal is outputted by the head driving apparatus of FIG. 1.

Also, in the case of C≧Cend in the step B13, the printing process operation is again moved to the step B4, since the printing operation for the remaining area is accomplished as shown in FIG. 6B, and then, the control unit 25 accomplishes the printing operation for 1 row.

As previously explained, in accordance with the head driving apparatus 10 of this embodiment of the present invention, in such a case that a total number of the piezoelectric elements 11 which should be simultaneously driven is larger than, or equal to the previously-set maximum number, the control unit 25 controls the nozzle selecting switch circuit 14, so that the control unit 25 limits a total quantity of drivable piezoelectric elements 11 to execute the printing operation.

As a consequence, the maximum quantity of the piezoelectric elements 11 which are driven at the same time may be reduced, and thus, the maximum currents of the transistors 13*a* and 13*b* may be decreased which are employed as the amplifying elements of the current amplifying circuit 13 which amplifies the drive signals to apply the amplified drive signals to the piezoelectric elements 11. As a consequence, the rated currents of the transistors 13*a* and 13*b* may be decreased, so that the cost of these transistors 13*a* and 13*b* may be decreased and also the power supply circuit containing the constant voltage Vcc may be made compact.

In this case, while the arrayed piezoelectric elements 11 are subdivided into two element groups from the center thereof, the respective transmission gates 14*a* and 14*b* are allocated to these element groups. As a result, as shown in FIG. 6A and FIG. 6B, the printing operation is carried out for a half of columns subsequent to a certain column. Alternatively, the piezoelectric elements 11 may be alternately allocated to the transmission gates 14*a* and 14*b* every either one or a predetermined number of transmission gates.

In this alternative case, a first printing operation corresponding to FIG. 6A is carried out in a so-called "zigzag" shape, and then, a second printing operation is carried out with respect to areas among these zigzag shape.

In the embodiment, the nozzle selecting switch circuit 14 includes the two transmission gates 14*a* and 14*b*, and the switch units are turned OFF every each of these transmission gates 14*a* and 14*b* in response to the control signal. The present invention is not limited to the arrangement. Alternatively, a single transmission gate (TG) may be provided and/or three, or more transmission gates may be employed. Alternatively, while the switch units are not turned OFF every transmission gate, each of these switch units may be turned OFF.

Figure 9A:
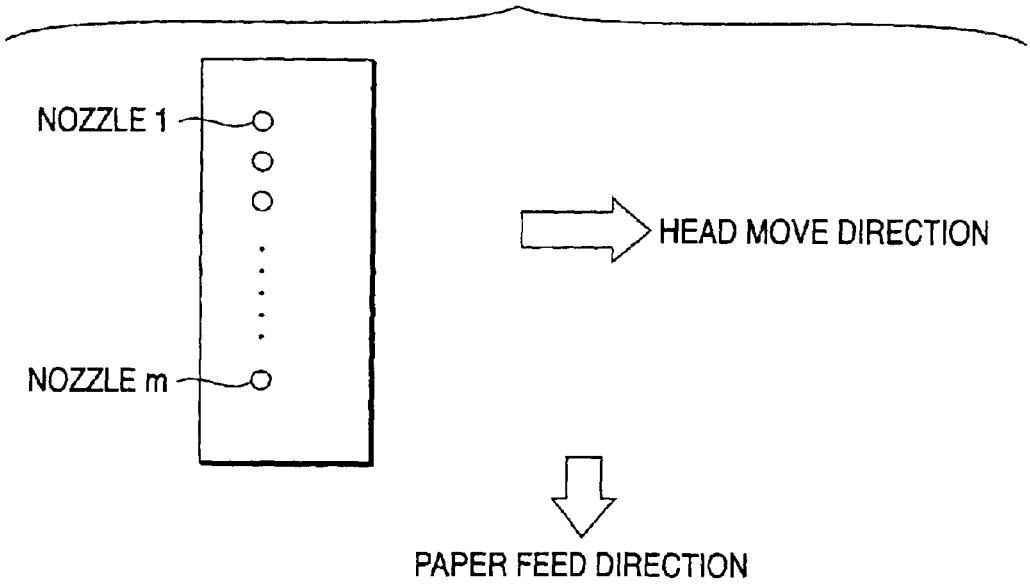
FIGS. 9A and 9B are schematic diagrams which show a modification in which nozzles are OFF-controlled every each of switch units by employing a single transmission gate (TG), namely FIG. 9A indicates a head structure of this modification.
Figure 9B:
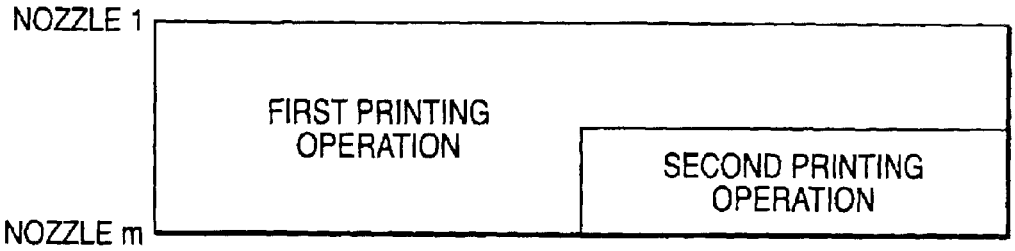
Figure 10:
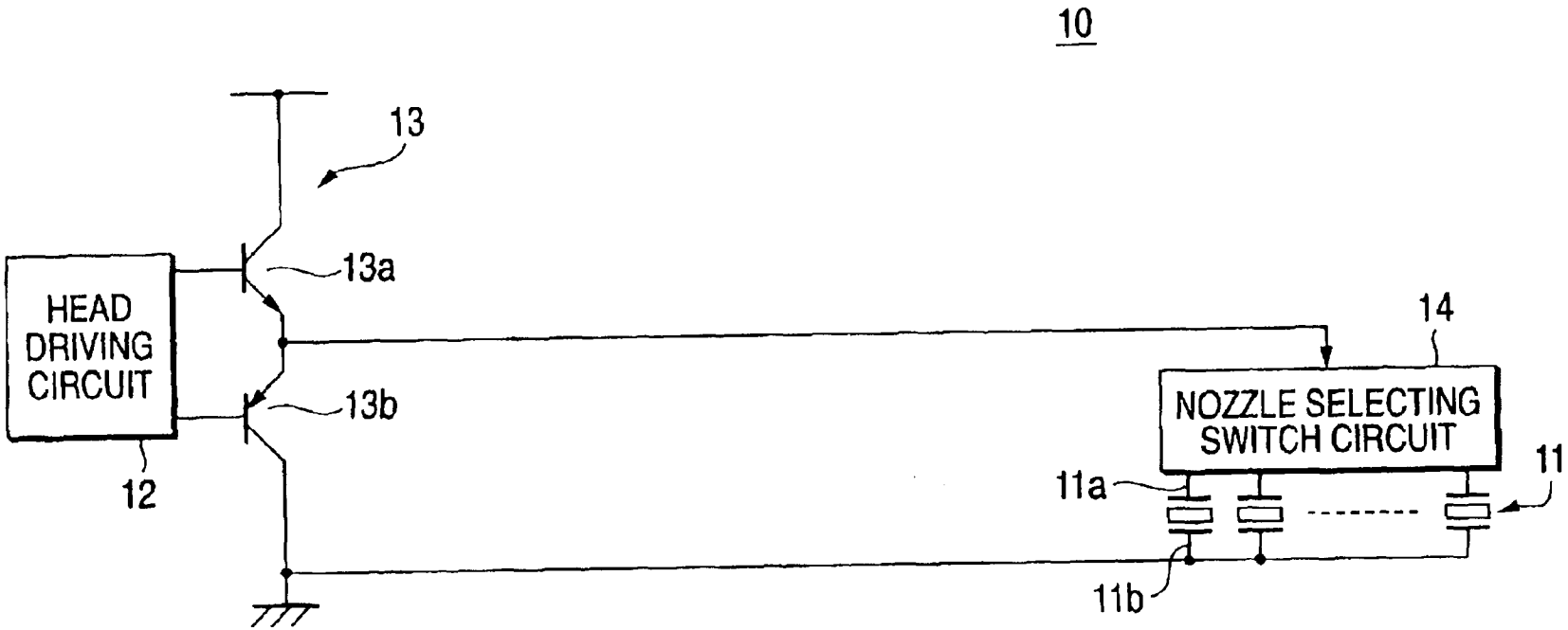
FIG. 10 is a block diagram which shows an example of the arrangement of the related head driving apparatus.

For instance, In such a case that nozzles "1" to "m" are controlled by employing a single transmission gate "TG" in a printer head having such a structure as shown in FIG. 9A, if such an arrangement is made that when a level of a restriction signal "Half" is an "H"-level, ON/OFF operations of only these nozzles "1" to "m/2" are determined by transfer data, and the nozzles "m/2+1" to "m" do not jet ink irrespective of data, then such a printing operation as shown in FIG. 9B is carried out.

Also, in the embodiment, in the nozzle selecting switch circuit 14, a half number of the entire switch units corresponding to the respective piezoelectric elements 11 are alternately turned OFF. The present invention is not limited to the embodiment Alternatively, while the switch units are subdivided into three, or more switch unit groups, one switch unit group is left, and the switch units of other groups are turned OFF, so that a printing operation may be carried out by sequentially operating only the switch units which constitute one group.

Furthermore, in the embodiment the transistors 13*a* and 13*b* are used as the amplifying elements of the current amplifying circuit 13. The present invention is not limited to this embodiment. Alternatively, other amplifying elements may be employed in this current amplifying circuit 13.

What is claimed is:

1. A head driving apparatus, comprising:

a plurality of nozzles;

a switch circuit, having a plurality of switch units corresponding to the nozzles, and selecting the nozzles from which a liquid droplet is jetted at predetermined jet timing;

a head driving circuit, supplying a drive signal to the switch circuit to jet the droplet from the nozzles;

a controller, supplying a control signal to the switch circuit so as to ON-OFF control the switch units every jet timing based upon jetting data; and a restriction signal generator, generating a restriction signal, wherein a part of the switch units are turned OFF in spite of the control signal supplied to the switch circuit when the switch circuit receives the restriction signal.

2. The head driving apparatus as set forth in claim 1, wherein the restriction signal generator calculates a total number of the switch units to be turned ON simultaneously in accordance with the control signal, and supplies the restriction signal to the switch circuit when the total number exceeds a predetermined number.

3. The head driving apparatus as set forth in claim 2, wherein the predetermined number is a half number of the entire switch units; and wherein the switch circuit turns OFF the half number of the entire switch units when the switch circuit receives the restriction signal.

4. The head driving apparatus as set forth in claim 1, wherein a first jetting operation is performed while the switch circuit brings a part of the switch units into an OFF state based upon the restriction signal; and wherein a second jetting operation is performed on the same path while the switch circuit brings the part of the switch units into an ON state and another part of the switch units into the OFF state after the first jetting operation is performed.

5. The head driving apparatus as set forth in claim 1, wherein a first jetting operation is performed while the switch circuit brings the half number of the entire switch units into an OFF state based upon the restriction signal; and wherein a second jetting operation is performed on the same path while the switch circuit brings the half of the switch units into an ON state and a remained part of the switch units into the OFF state after the first jetting operation is performed.

6. The head driving apparatus as set forth in claim 1, wherein the restriction signal generator calculates a simultaneous drivable number of piezoelectric elements applying pressure to liquid so as to jet a liquid droplet from the nozzles, based upon a maximum inclination of a waveform of the drive signal, a capacitance of the piezoelectric element per a single nozzle, and an allowable current of an amplifier circuit which amplifies the drive signal, and stores the calculated result as the predetermined number.

7. A nozzle selecting IC, comprising;

a selector, selecting a jetting nozzle from a plurality of nozzles based upon jetting data; and a restrictor, restricting a specific nozzle of the nozzles to a non-jetting state in response to a restriction signal supplied from an external in spite of the jetting data.

8. A method for driving a head driving apparatus, comprising the steps of:

providing a plurality of nozzles;

supplying a drive signal for jetting a liquid droplet from the nozzles;

supplying a control signal for controlling a jet of the liquid droplet based upon jetting data every jet timing;

selecting the nozzles from which the liquid droplet is jetted in accordance with the control signal at predetermined jet timing; and restricting a part of the nozzles into a non-jetting state in spite of the control signal.

9. The method as set forth in claim 8, further comprising a step of calculating a total number of the nozzles from which the liquid droplet is jetted simultaneously in accordance with the control signal, and wherein the part of the nozzles are restricted into a non-jetting state in spite of the control signal when the total number exceeds a predetermined number.

10. The method as set forth in claim 9, wherein a half number of the entire nozzles are restricted into the non-jetting state when the total number exceeds a predetermined number.

11. The method as set forth in claim 8, further comprising:

performing a first jetting operation while a part of the nozzles are restricted into a non-jetting state; and performing a second jetting operation on the same path while the part of the nozzles are in a jetting state and another part of the nozzles are in the non-jetting state.

12. The method as set forth in claim 8, further comprising:

performing a first jetting operation while a half number of the entire nozzles are restricted into a non-jetting state; and performing a second jetting operation on the same path while the half of the entire nozzles are in a jetting state and the remainder of the nozzles are in the non-jetting state.

13. A head driving apparatus, comprising:

a plurality of nozzles from which a liquid droplet is jetted; and a storing unit, storing jetting data for jetting the liquid droplet on a one path in a movement of a jetting head having the nozzles, the jetting data having a first part and a second part, wherein a jetting of the liquid droplet in accordance with the first part of the jetting data is performed in a jetting operation of the one path; and wherein a jetting of the liquid droplet in accordance with the second part of the jetting data is not performed in the jetting operation of the one path.

14. The head driving apparatus as set forth in claim 13, wherein the jetting of the liquid droplet in accordance with the second part of the jetting data is not performed when a restriction signal is received.

15. The head driving apparatus as set forth in claim 14, wherein the restriction signal is received during the jetting operation of the one path.

16. The head driving apparatus as set forth in claim 14, wherein the restriction signal is received when a total number of the nozzles to be jetted simultaneously exceeds a predetermined number.

17. The head driving apparatus as set forth in claim 13, further comprising a restrictor, restricting a part of the nozzles so that the liquid droplet is jetted from only the other part of the nozzles; and wherein the restrictor determines whether the part of the nozzles is restricted every jet timing of the liquid droplet.

18. The head driving apparatus as set forth in claim 13, further comprising a divider, dividing the jetting data, wherein the divider divides the second part of the jetting data into a plurality of divided data; and wherein the liquid droplet is jetted in a plurality of jetting operations in accordance with the plurality of divided data respectively after the jetting operation of the one path is finished.

19. The head driving apparatus as set forth in claim 13, wherein the first part and the second part of the jetting data are defined during the period when the liquid droplet is jetted in accordance with the jetting data.

20. A method for driving a head driving apparatus, comprising the steps of:

providing a plurality of nozzles from which a liquid droplet is jetted;

providing a storing unit;

storing a jetting data in the storing unit, the jetting data having a first part and a second part;

performing a jetting of the liquid droplet in accordance with the first part of the jetting data in a jetting operation of one path; and restricting a jetting of the liquid droplet in accordance with the second part of the jetting data in the jetting operation of the one path.

21. The method as set forth in claim 20, wherein the jetting of the liquid droplet in accordance with the second part of the jetting data is not performed when a restriction signal is received in the restricting step.

22. The method as set forth in claim 21, wherein the restriction signal is received during the jetting operation of the one path.

23. The method as set forth in claim 21, wherein the restriction signal is received when a total number of the nozzles to be jetted simultaneously exceeds a predetermined number.

24. The method as set forth in claim 20, further comprising the steps of restricting a part of the nozzles so that the liquid droplet is jetted from only the other part of the nozzles; and determining whether the part of the nozzles is restricted every jet timing of the liquid droplet.

25. The method as set forth in claim 20, further comprising the steps of dividing the second part of the jetting data into a plurality of divided data;

jetting the liquid droplet in accordance with the divided data after the jetting operation of the one path is finished; and repeating the jetting step of the divided data until the liquid droplet is jetted in accordance with all divided data.

26. The method as set forth in claim 20, wherein the first part and the second part of the jetting data are defined during the period when the liquid droplet is jetted in accordance with jetting data.

* * * * *